US005446947A

United States Patent [19]

Lee

[11] Patent Number: 5,446,947

[45] Date of Patent: Sep. 5, 1995

[54] MULTI-PURPOSE KEY HOLDER

[76] Inventor: Geon W. Lee, 943 S. Magnolia Ave., Los Angeles, Calif. 90006

[21] Appl. No.: 287,520

[22] Filed: Aug. 8, 1994

[51] Int. Cl.[6] ..... A44B 15/00

[52] U.S. Cl. ..... 24/3.6; 70/456 R; 224/252; 206/37.1

[58] Field of Search ..... 24/3 E, 3 F, 3 R, 3 K, 24/370, 601.5, 601.6; 70/456 R, 457, 450; 206/37.1, 38.1; 224/252

[56] References Cited

U.S. PATENT DOCUMENTS

| | | | |
|---|---|---|---|
| 3,916,659 | 11/1975 | Leopoldi | 70/456 R |
| 3,968,670 | 7/1976 | Quenot | 70/456 R |
| 4,113,156 | 9/1978 | Brito | 24/3 K X |
| 4,226,105 | 10/1980 | Wehrman | 24/3 K X |
| 4,776,191 | 10/1988 | Macdonald | 70/459 |
| 4,821,543 | 4/1989 | Scungio | 70/456 R |
| 4,888,970 | 12/1989 | Kinzler et al. | 70/456 R |
| 5,174,139 | 12/1992 | Huang | 24/3 K X |
| 5,312,029 | 5/1994 | Tuber | 24/3 F X |

FOREIGN PATENT DOCUMENTS 1558403 1/1969 France .

*Primary Examiner*—Kenneth J. Dorner
*Assistant Examiner*—Robert J. Sandy

[57] ABSTRACT

A key ring holder with two specific areas to which key rings may be easily attached with one hand. The key ring holder may be affixed to a belt strap for convenience. Key rings may be suspended from either a horizontally or vertically installed half-ring. The horizontally attached half-ring is attached to a spring which is installed within the key ring holder, giving it an elastic quality. A pivoting locking device contains a protruding segment which is inserted into an indentation on the opposite side, thus locking the key ring holder onto a belt.

1 Claim, 4 Drawing Sheets

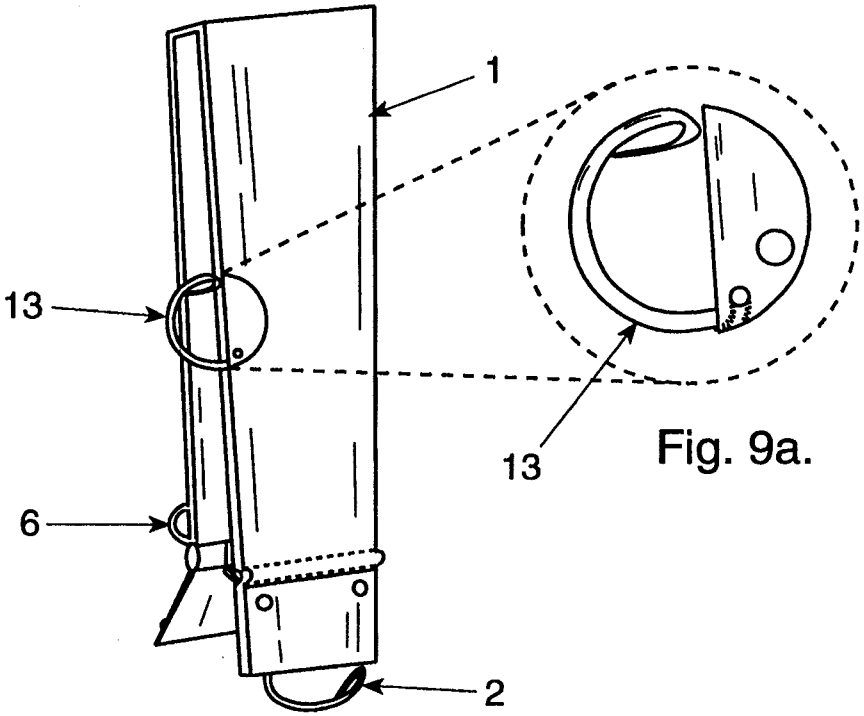
Fig. 9a.
Fig. 9.
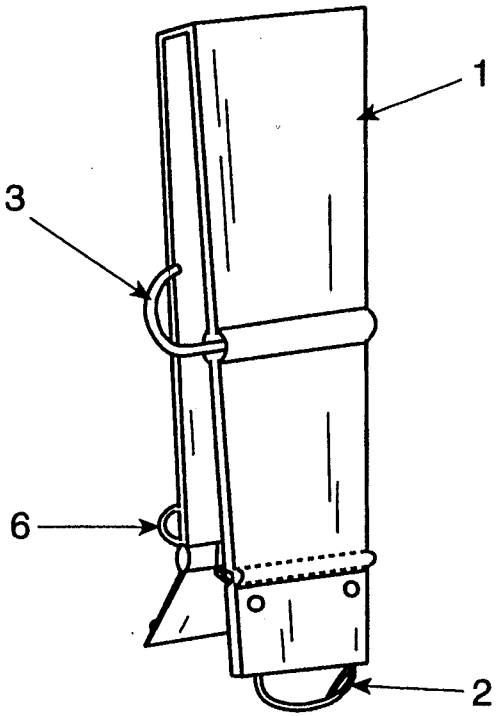
Fig. 8.

MULTI-PURPOSE KEY HOLDER

FIELD OF THE INVENTION

The present invention generally relates to a key holder, particularly to a key holder which may be operated using only one hand.

BACKGROUND OF THE INVENTION

Many devices have been invented with the purpose of holding keys. Such devices are disclosed in U.S. Pat. Nos. 4,776,191 entitled Key Holder to MacDonald, 4,164,132 entitled Key Retainer to Loman, 4,113,156 entitled Key Ring Holder to Brito, 4,324,121 entitled Key Ring to Richter, 4,226,105 entitled Key Ring Holder to Wehrman, 3,970,227 entitled Spring Loop Key Ring and Belt Attachment to Hardy.

However, these devices do not alleviate the difficulty of sliding keys into traditional, stiff keyrings. Most people have experienced the frustration of trying to slide a thick key into or out of a tight, metal keyring. Not only does this task require strength, but one's finger nail can also be broken in the process.

In addition, many key holders provide only one of these metal rings, making it difficult for an average individual to distinguish one key among many. The correct key is seldom identified accurately at first glance.

SUMMARY OF THE INVENTION

The presently invented key ring holder comprises a rectangular strip made of a material including but not limited to metal, consisting of two specific areas to which rings may be attached. The key holder is similar to a money clip in that one end of the key holder may be clipped onto or attached to one'belt strap.

The other end of the key holder is used to lock and keep the key holder in place. The bottom end of the key holder includes a pivoting piece with a protruding segment which automatically locks the key holder onto the belt strap when the protruding segment is inserted into a slit situated on the opposite side.

The very bottom end of the key holder contains an elastically attached half-ring which opens just enough for a key ring to slide onto it. The middle area of the strip has another half-ring attached to the key holder bey means of a spring and protruding horizontally to one side. This half-ring also opens just enough for a key ring to slide into it. Thus, keys which have been attached to corresponding rings may be securely suspended from either of these half-rings. Furthermore, a much smaller, enclosed half-ring is positioned on the opposite side which allows other items to be attached to the key holder.

In addition, a pager or clock may be fastened to the presently invented key holder.

Accordingly, it is a primary object of the present invention to provide a key holder which may be operated using only one hand.

It is another object of the present invention to provide an elastic key holder.

It is another object of the present invention to provide a multi-purpose key holder.

It is another object of the present invention to provide a key holder which is able to hold keys in two separate areas.

It is another object of the present invention to provide a key holder which is both simple and attractive in structure.

It is a further object of the present invention to provide a key holder which allows attachment of other items such as pagers and clocks.

It is a further object of the present invention to provide a key holder which may be fastened to a belt for convenience.

The invention possesses other advantageous objects and features which will become apparent from the following description and drawings. It is to be understood, however, that the invention is not limited to the embodiment illustrated and described since it may be embodied in various forms within the scope of its purpose.

BRIEF DESCRIPTION OF THE DRAWING

FIG. 8 is a perspective view of the key ring holder

FIG. 9 is a perspective view of the key ring holder showing an alternative half-ring to be used on the side.

DETAILED DESCRIPTION OF THE PREFERRED EMBODIMENTS

Figure 1:
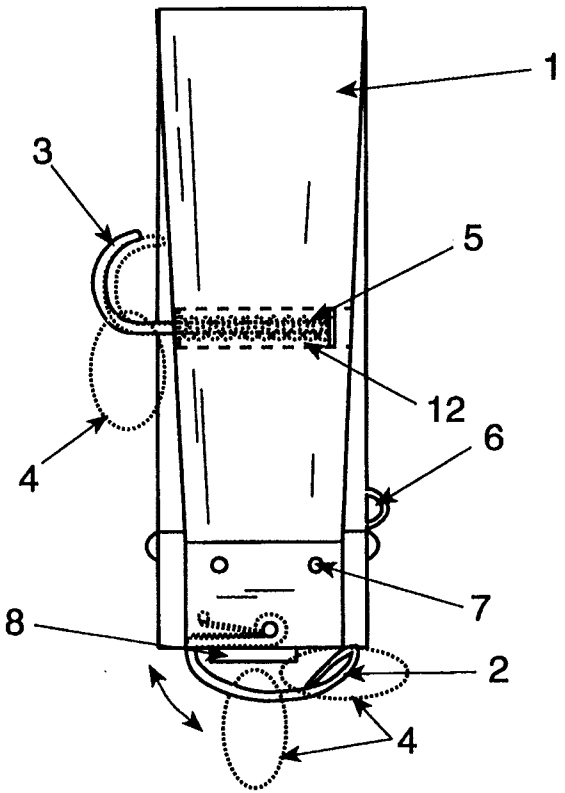
FIG. 1 is a front view of the key ring holder exhibiting the interior elements.

Referring now to FIG. 1, a front view of the key ring holder 1 is shown. A vertical half-ring 2 attached to the bottom of the key ring holder 1 opens just enough to allow key rings 4 to slide onto it. A horizontal half-ring 3 is given elasticity by a spring 5, thus enabling the horizontal half-ring 3 to be pulled outward just enough for key rings 4 to slide onto it. A cylindrical tube 12 is located within the key holder 1 in order-to accomodate the spring 5. The enclosed half-ring 6 allows other items to be attached to the key ring holder. Rivets 7 are placed in various positions on the key ring holder in order to hold the invention together. A lever 8 is located on the bottom of the key ring holder 1 for the user to open the vertical half-ring 2 with more ease.

Figure 2:
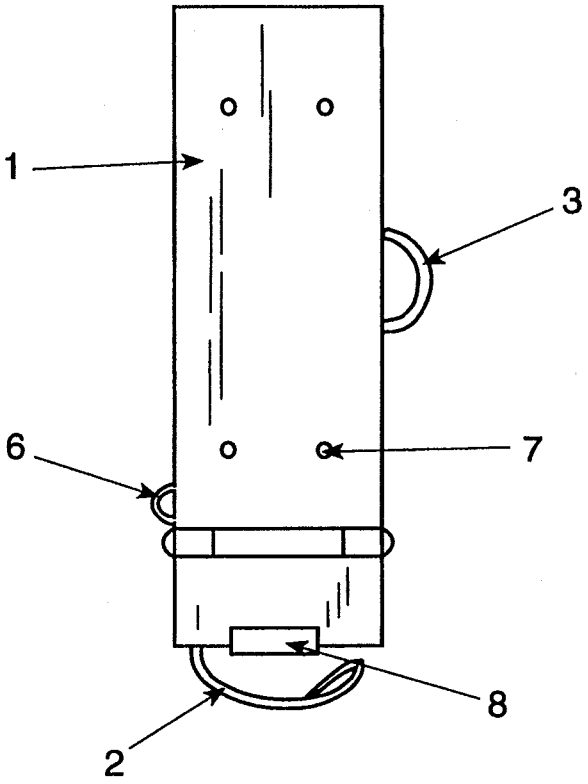
FIG. 2 is a rear view of the key ring holder.

Referring now to FIG. 2, a rear view of the key ring holder is shown without any attached key rings 4. A rear view of most of the elements of FIG. 1 are shown.

Figure 4:
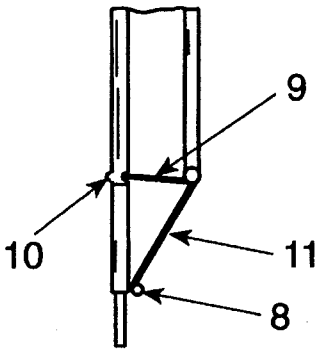
FIG. 4 is a sectional side view of the key ring holder.
Figure 5:
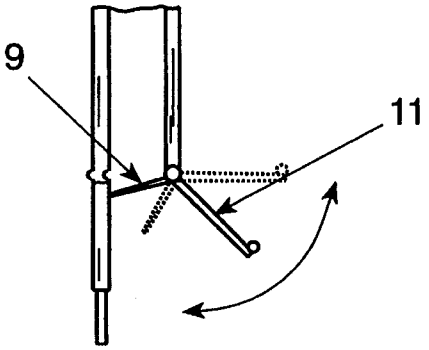
FIG. 5 is a sectional side view of the key ring holder.
Figure 3:
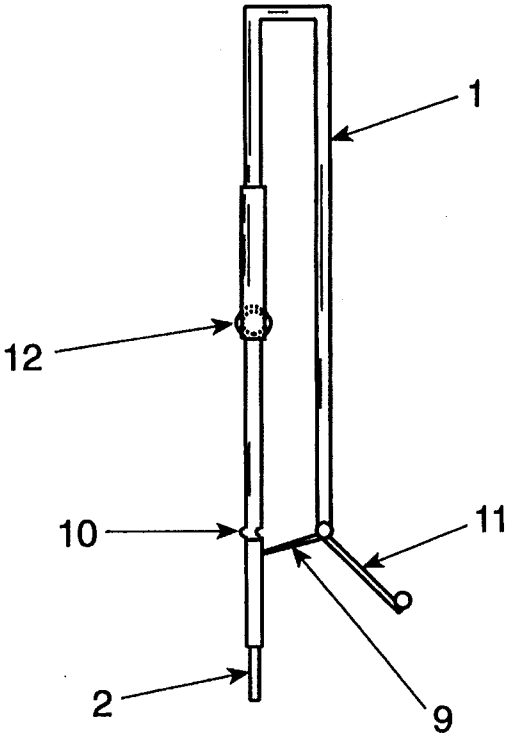
FIG. 3 is a perspective side view of the key ring holder.

FIG. 3 is a side view of the key ring holder i in which the cylindrical tube 12 installed within the key ring holder 1 is more clearly shown. A segment 9 which protrudes from a pivoting piece 11 swings forward and snaps into an indentation 10, thereby locking the key ring holder 1, as shown in FIG. 4. FIG. 5 shows the locking assembly of FIG. 4 in its unlocked position, further demonstrating the range of movement of the pivoting piece 11.

Figure 7:
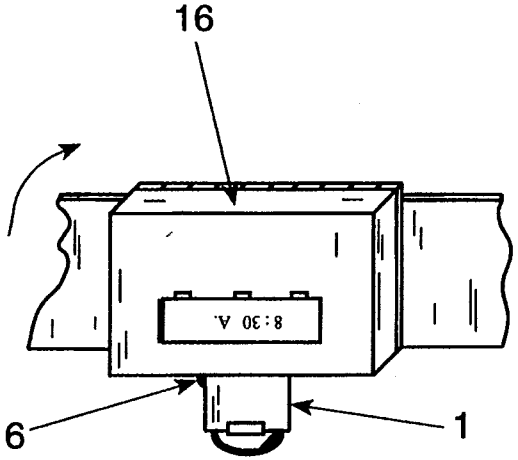
FIG. 7 shows a pager attached to the key ring holder.
Figure 6:
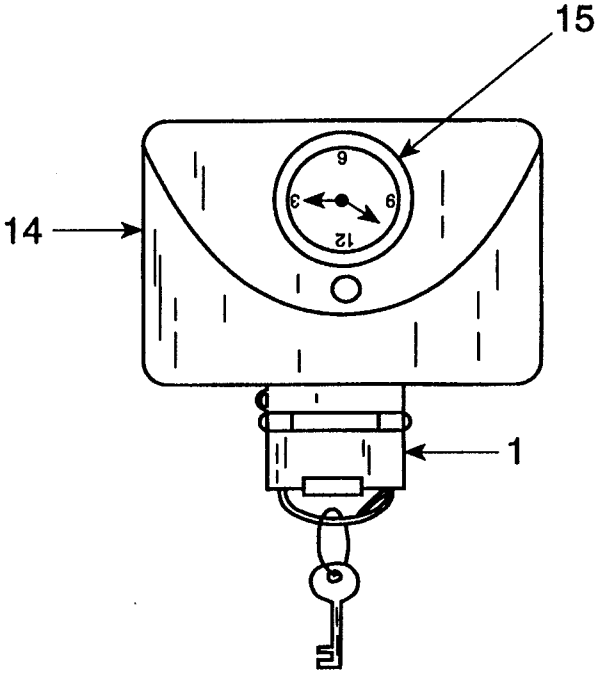
FIG. 6 shows a clock purse attached to the key ring holder.

FIG. 6 shows a purse with a clock 14 attached to the key ring holder 1. FIG. 7 shows a pager 16 attached to the key ring holder 1. Both FIG. 6 and FIG. 7 demonstrate the multi-purpose ability of the present invention. Furthermore, an enclosed half-ring 6 allows other items to be attached to the key ring holder.

Referring now to FIG. 8 and FIG. 9, an alternative half-ring is shown. The alternative half-ring 13 in FIG. 9 may be substituted for the horizontal half-ring 3 in FIG. 8. This alternative half-ring 13 does not require a spring or a cylindrical tube.

I claim:

1. A key ring holder comprising:

a body made of a material including but not limited to metal comprising two parallel rectangular panels connected at one end by a short rectangular panel;

a pivoting locking device attached to one panel of said body;

a segment protruding from said pivoting locking device;

an indentation in the opposite panel of said body from said locking device for accomodating said protruding segment;

a small, enclosed half-ring protruding from one side of said body;

a vertical moveable half-ring protruding from the opposite end of said body from the short rectangular panel;

a horizontal moveable half-ring elastically attached to said body on the side of said body opposite said enclosed half-ring;

a cylindrical tube installed within one of said panels;

a spring installed within said cylindrical tube elastically attaching said horizontal half-ring to said body;

small key rings to be suspended from both of said moveable half-rings;

rivets holding said body together;

a lever proximally located to said vertical half-ring.

* * * * *